US005906288A

United States Patent [19]

Dwinell

[11] Patent Number: 5,906,288

[45] Date of Patent: May 25, 1999

[54] ANTI-GLUG VENT FOR PLASTIC PAILS

[75] Inventor: Davis B. Dwinell, Carol Stream, Ill.

[73] Assignee: Royal Packaging Industries Van Leer N.V., Amstelveen, Netherlands

[21] Appl. No.: 08/863,145

[22] Filed: May 27, 1997

[51] Int. Cl.[6] ..... B65D 51/16

[52] U.S. Cl. ..... 220/271; 220/367.1; 220/259; 222/482; 222/541.5; 222/541.9

[58] Field of Search ..... 220/712–715, 220/231, 254, 268, 271, 367.1, 601, 259, 256; 215/307, 310, 262; 222/482, 541.5, 541.6, 541.9

[56] References Cited

U.S. PATENT DOCUMENTS

| | | | |
|---|---|---|---|
| 1,296,341 | 3/1919 | Towle | 220/203.08 |
| 3,083,858 | 4/1963 | Biedenstein . | |
| 3,101,878 | 8/1963 | Bee . | |
| 3,416,712 | 12/1968 | Shastal | 222/541.5 |
| 3,739,976 | 6/1973 | MacDaniel | 220/231 X |
| 3,888,199 | 6/1975 | Herrmann | 413/18 X |
| 4,054,228 | 10/1977 | Balocca et al. | 220/268 |
| 4,213,538 | 7/1980 | Boardman | 220/271 X |
| 4,553,684 | 11/1985 | Bennett | 220/268 |
| 5,147,057 | 9/1992 | Marshall et al. | 220/254 X |

FOREIGN PATENT DOCUMENTS

| | | | |
|---|---|---|---|
| 80/01558 | 8/1980 | WIPO | 220/268 |

*Primary Examiner*—Stephen K. Cronin
*Assistant Examiner*—Nathan Newhouse

[57] ABSTRACT

A cover for plastic pails having a dispensing closure adjacent the cover periphery which allows unimpeded flow of liquid from the pail. An anti-glug vent device is integrally molded in the cover diametrically opposite from the dispensing closure to permit surge free, controlled pouring. A vent panel is disposed in the central top wall of the cover bounded by a cutting zone of reduced cross section and a hinge connection to the cover. An axially disposed actuating lever extends upwardly from the central area of the vent panel. To activate the vent for smooth pouring, the cutting zone is cut with a knife or punctured with a screw driver allowing the vent to open by pushing the actuating lever away from the cutting zone causing the vent panel to pivot about the hinge connection. To reclose the vent, the pivoting action on the actuating lever is reversed causing the cutting zone on the vent panel to become frictionally engaged within the resulting opening in the pail cover.

3 Claims, 2 Drawing Sheets

ANTI-GLUG VENT FOR PLASTIC PAILS

This invention is directed to injection molded plastic pails and more particularly to an anti-glug pouring vent integrally molded in the top surface of a molded plastic pail lid.

BACKGROUND OF THE INVENTION

In the dispensing of fluid from large volume containers such as five gallon pails achieving a smooth rapid flow without surging or gluging is always desirable. Such non-pulsating flow is currently accomplished by a variety of arrangements all of which are successful to a degree and al of which have certain deficiencies which the invention seeks to overcome. Incorporating an anti-glug feature in the primary pouring spout dispensing closure is perhaps the most popular approach in that it avoids any addition of labor in the pail manufacture. Such vented dispensing closures, however, are frequently more costly to produce but more importantly, their construction which attempts to freely permit the entry of air at atmospheric pressure, significantly restricts the outflow of fluid. The resulting dispensing performance of these arrangements where air is trying to enter and fluid is trying to exit through the same opening can only be characterized as "disappointing". Another common and very effective arrangement is to provide a completely separate vent closure inserted in the container top diametrically opposite the dispensing closure. This construction produces an excellent flow characteristic but is quite costly in pail manufacturing terms due to the additional component and labor for its insertion. The most cost effective approach, of course, is to simply punch a hole in the top of the container opposite the dispensing closure. This method lacks practicality in that it tends to freely let fluid out and foreign matter in. Finally, several arrangements have been brought forward attempting to integrate an anti-glug vent into the structure of the pail top which have obvious security advantages but have fallen short of commercial use due to undue complexity of molding or impracticality of function.

SUMMARY OF THIS INVENTION

This invention embraces the advantages of optimum pouring speed and smoothness combined with economy of manufacture. In addition the invention adequately addresses the functional requirements of easy access and effective reclosing. This has been accomplished by providing a full flow dispensing closure in the top of a molded plastic pail closely adjacent the sidewall thereof. Diametrically opposite the dispensing closure on the top of the pail is an integrally molded anti-glug vent also closely adjacent the edge of the pail top. The vent consists of a moveable panel molded in the pail top having a flexible hinged connecting edge and otherwise defined by a zone of reduced cross sectional thickness suitable for cutting or puncturing. The vent panel is further provided with an upstanding actuating lever to enable opening and closing movement of the panel about the hinge connection once the cutting zone has been severed.

It is accordingly a principal object of the invention to provide a new and improved anti-glug pouring vent for industrial size plastic containers.

A further object is to provide a recloseable anti-glug pouring vent integrally molded in the top of a plastic pail diametrically opposite a full flow dispensing closure.

A more detailed object is to provide an integrally molded plastic pouring vent easily opened with a simple tool and capable of repeated reclosing.

Further and more detailed objects will in part be apparent and in part pointed out as the description of the invention taken in conjunction with the accompanying drawing proceeds.

Figure 1:
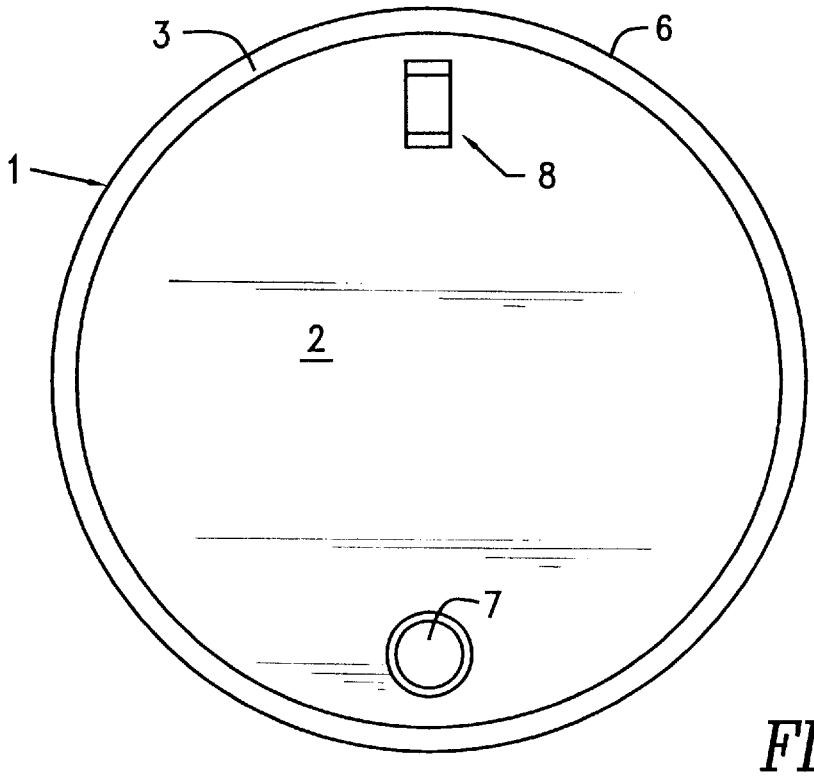
FIG. 1 is a top plan view of a pail lid with a pouring vent and dispensing closure in accordance with the invention.
Figure 4:
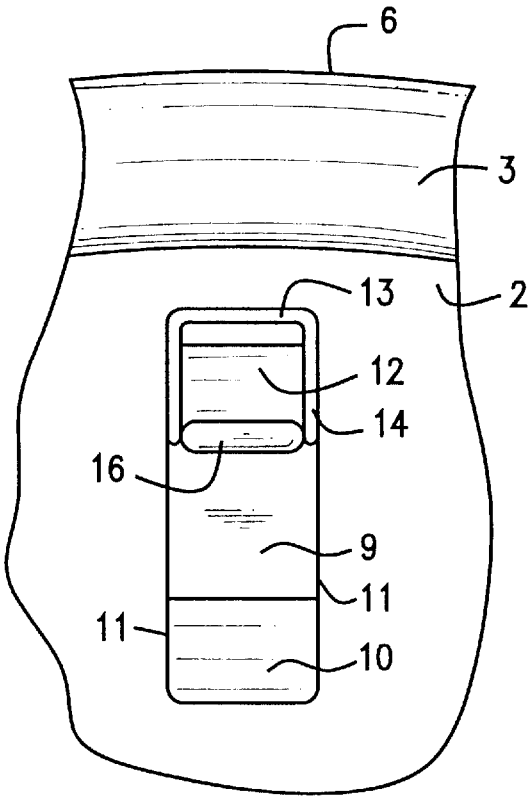
FIG. 4 is an enlarged top plan view of the pouring vent per se as molded.
Figure 2:
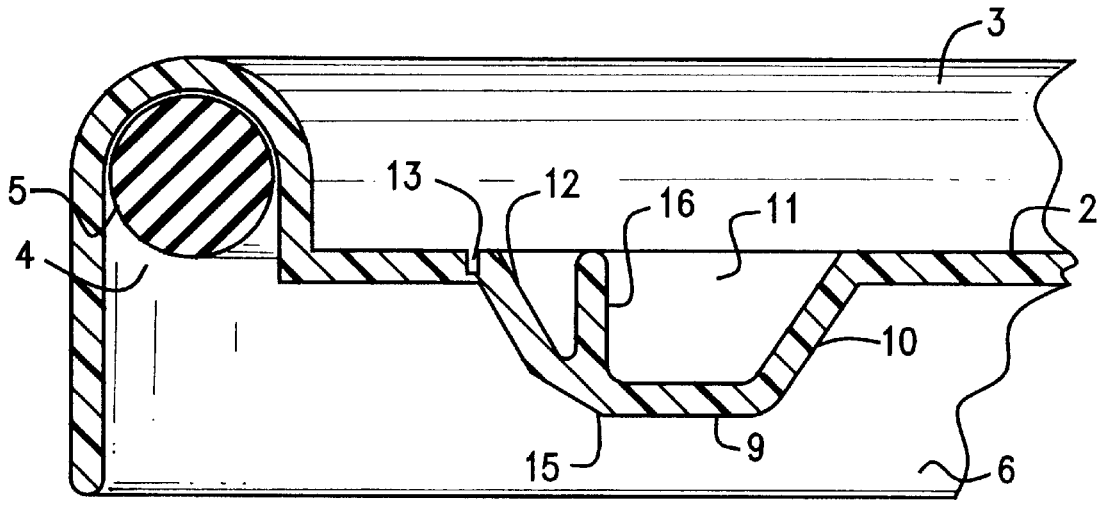
FIG. 2 is a fragmentary elevational view in vertical cross section of the vent.
Figure 3:
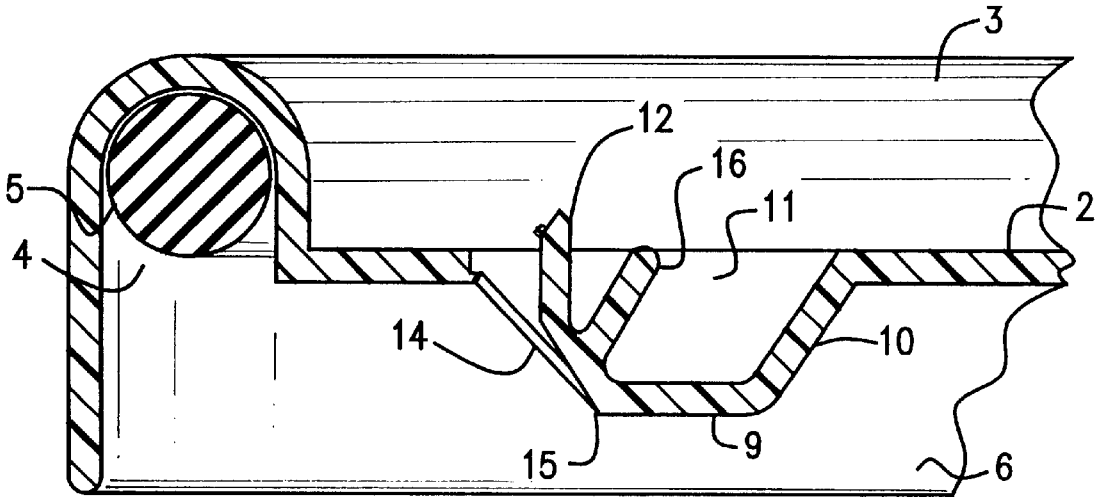
FIG. 3 is a fragmentary view similar to FIG. 3 with the vent in open or venting position.

A pail lid or cover I is formed with a recessed central top wall 2 surrounded by a raised chime 3. The chime creates an interior sealing channel 4 housing a resilient sealing gasket 5 and extends into an outer cylindrical wall 6 about the periphery of the lid. A dispensing closure 7 capable of full flow pouring of the liquid contents is located in the lid top wall at a position adjacent the chime 3. Diametrically opposite the dispensing closure 7 there is an air entry pouring vent generally indicated at numeral 8 also closely adjacent the chime. The anti-glug or anti-surge vent 8 is integrally molded in the top wall 2 and consists of a rectangular recess having a bottom wall 9, a sloping end wall 10, two side walls 11 and a sloping vent panel 12. As clearly seen in FIG. 4 the vent panel is defined by a three sided cutting or puncturing zone of reduced cross sectional thickness extending along the top wall at 13 and along the side walls 11 at 14. The lower edge of the vent panel 12 is joined to the bottom wall 9 by a hinge connection 15 which as seen in FIG. 2 also has a reduced cross sectional thickness to aid flexibility. Lever 16 is integrally molded on the vent panel 12 and extends upwardly from the vent recess. With this arrangement the vent structure and particularly the actuating lever is stored in a relatively protected position so that stacking one pail on top of another is unlikely to cause damage.

Initial activation of the vent is accomplished by cutting or puncturing with an implement such as a knife or screw driver, along the three sided cutting zone. This action unseals the vent and readies it for repeated use. Pulling the lever 16 radially inwardly opens the vent by swinging the vent panel 12 about the hinge connection 15. In this open position pouring through the unrestricted dispensing closure 7 is very fast and smooth. To hold the partially emptied pail in stored condition, the lever 16 is simply pushed back again radially outwardly closing off the three severed sides of the vent panel so that splashing out of liquid contents and entry of foreign matter are both effectively prevented. The resiliency of the hinge connection 15 together with the frictional reengagement of the sides of the vent panel is sufficient to hold the vent panel in a surprisingly tightly closed position.

Various other changes in or modifications of the anti-glug pouring vent of the invention would suggest themselves to those skilled in the art and could be made without departing from the spirit or scope of this invention. It is accordingly intended that all matter contained in the above description or shown in the accompanying drawing shall be interpreted as being illustrative and not in a limiting sense.

I claim:

1. An industrial size pail lid molded of synthetic plastic material having a disc like top wall surrounded by a peripheral depending skirt adapted for securement to a pail, a fluid dispensing closure positioned adjacent said skirt, a recessed integrally molded anti-glug vent disposed within said top wall adjacent said skirt diametrically opposite said dispensing closure, said vent comprising a moveable panel extending from said top wall into said recess, a hinge connection at the juncture of said moveable panel and the bottom of said recess, an elongated actuating lever integrally connected to said moveable panel with the major portion of said lever housed within said recess and a cutting zone having a reduced cross sectional thickness defining said panel whereby severing said cutting zone releases said moveable panel from said top wall for movement by said actuating means to an open position allowing air entry to facilitate smooth, controlled pouring from said dispensing closure and permits frictional reengagement upon reclosing for storage.

2. A pail lid as in claim 1 wherein said cutting zone is upwardly exposed for reception of a severing implement with at least a portion of said cutting zone completely formed in said top wall adjacent the juncture of said moveable pane.

3. A pail lid as in claim 1 wherein said moveable panel slopes into said recess, and said elongated actuating lever is wholly connected to said moveable panel and extends upwardly therefrom.

* * * * *